US007499670B2

(12) United States Patent
Kim

(10) Patent No.: US 7,499,670 B2
(45) Date of Patent: Mar. 3, 2009

(54) PROCESS CARTRIDGE HAVING CLEANING UNIT INCLUDING A BENT PORTION FOR IMAGE FORMING APPARATUS

(75) Inventor: Young-min Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 6 days.

(21) Appl. No.: 11/435,874

(22) Filed: May 18, 2006

(65) Prior Publication Data

US 2007/0041761 A1 Feb. 22, 2007

(30) Foreign Application Priority Data

Aug. 16, 2005 (KR) ..... 10-2005-0074978

(51) Int. Cl.
*G03G 21/00* (2006.01)

(52) U.S. Cl. ..... 399/351

(58) Field of Classification Search ..... 399/351
See application file for complete search history.

(56) References Cited

U.S. PATENT DOCUMENTS

| | | | | |
|---|---|---|---|---|
| 5,682,579 | A | 10/1997 | Nomura et al. | |
| 5,966,567 | A | 10/1999 | Matsuzaki et al. | |
| 6,154,623 | A * | 11/2000 | Suzuki et al. | 399/111 |
| 6,519,431 | B1 | 2/2003 | Toba et al. | |
| 6,836,639 | B2 | 12/2004 | Karakama et al. | |
| 7,158,749 | B2 * | 1/2007 | Ueno et al. | 399/351 |
| 2003/0016955 | A1 | 1/2003 | Hiratsuka et al. | |
| 2003/0235424 | A1 * | 12/2003 | Kawahara et al. | 399/71 |

FOREIGN PATENT DOCUMENTS

| | | |
|---|---|---|
| JP | 10-171329 | 6/1998 |
| JP | 2001-034146 | 2/2001 |
| JP | 2003-177651 | 6/2003 |
| JP | 2004-045571 | 2/2004 |
| JP | 2004-317977 | 11/2004 |

OTHER PUBLICATIONS

Office Action issued by Korean Intellectual Property Office in Korean Patent Application No. 2005-74978 on Oct. 18, 2006.
Office Action issued by the Chinese Patent Office in Chinese Patent Application No. 2006101087949 on Apr. 4, 2008.

* cited by examiner

*Primary Examiner*—Quana M Grainger
(74) *Attorney, Agent, or Firm*—Stein, McEwen & Bui, LLP

(57) ABSTRACT

A process cartridge for an image forming apparatus includes a cleaning unit for removing waste toner remaining on a surface of a photosensitive drum, and a cleaning frame for storing the waste toner removed by the cleaning unit. The cleaning unit includes a bent portion adapted to bend in a direction opposite to the photosensitive drum and be disposed at a site other than that in which the waste toner is accumulated. The cleaning unit further includes a cleaning blade for contacting with the surface of the photosensitive drum to remove the waste toner remaining thereon in response to rotation of the photosensitive drum, and a cleaning support member for supporting the cleaning blade.

40 Claims, 11 Drawing Sheets

PROCESS CARTRIDGE HAVING CLEANING UNIT INCLUDING A BENT PORTION FOR IMAGE FORMING APPARATUS

CROSS-REFERENCE TO RELATED APPLICATION

This application claims benefit under 35 U.S.C. § 119(a) of Korean Patent Application No. 2005-74978, filed on Aug. 16, 2005 in the Korean Intellectual Property Office, the entire disclosure of which is incorporated herein by reference.

BACKGROUND OF THE INVENTION

1. Field of the Invention

Aspects of the present invention relate to an electrophotographic image forming apparatus. More particularly, Aspects of the present invention relate to a process cartridge for an image forming apparatus.

2. Description of the Related Art

An electrophotographic image forming apparatus uses a process cartridge. The process cartridge includes an electrophotographic photosensitive drum and related processing mechanisms and is adapted to be detachably mountable as a unit in a main body of the electrophotographic image forming apparatus. The process cartridge is an easily replaceable cartridge that packages components having substantially the same service life such as various rollers constituting the photosensitive drum and a developing unit and a predetermined amount of toner.

The process cartridge B and electrophotographic image forming apparatus 100 using the cartridge B are illustrated in FIGS. 1 to 3. FIG. 1 shows the configuration of a conventional image forming apparatus 100. FIG. 2 is a perspective view showing the external appearance of a process cartridge B of FIG. 1. FIG. 3 is a sectional view showing the internal configuration of the process cartridge B. Referring to FIGS. 1 to 3, the process cartridge B is detachably mounted in a main body A of the image forming apparatus 100. In the image forming apparatus 100, a photosensitive drum 111 is charged by a charge roller 112, and an electrostatic latent image is formed on the surface of the photosensitive drum 111 by a laser beam L from a laser scanning unit 130. The electrostatic latent image is developed into a desired visible image with toner transported from a toner chamber 118 by a supplying roller 115 in response to rotation of the photosensitive drum 111. The developed visible image is transferred to a sheet of recording paper P passing between the photosensitive drum 111 and a transferring roller 140.

In a cartridge frame 110 of the process cartridge B, the toner chamber 118 is provided at one side of the photosensitive drum 111, and a waste toner chamber 123 is provided at the other side of the photosensitive drum 111. Around the toner chamber 118, a developing roller 114, the supplying roller 115, a doctor blade 116 and an agitator 117 are installed in sequence and are supported by a main frame 119. Around the waste toner chamber 123, the charge roller 112, a cleaning blade 121 and the like are installed in sequence and are supported by a cleaning frame 124. The cleaning blade 121 is attached to a cleaning support member 122. However, in the process cartridge B, because a bent portion 122*a* of the cleaning support member 122 is bent towards the photosensitive drum 111, a beam inlet 131 for the laser beam L from the laser scanning unit 130 is too narrow. In particular, as shown in FIG. 3, in the image forming apparatus provided with a cleaning roller 113 and the charge roller 112, the end of the bent portion 122*a* may contact with the charge roller 112 or the cleaning roller 113. Consequently, to allocate a sufficient space for the beam inlet 131 of the laser scanning unit 130, the size of the developing roller 114 must be increased, complicating a space allocation problem in the process cartridge B. To solve this space allocation problem, an image forming apparatus adopting an enhanced process cartridge B' has been disclosed in U.S. Pat. No. 6,836,639.

FIG. 4 is a sectional view showing the internal configuration of the process cartridge B' disclosed in U.S. Pat. No. 6,836,639, and FIG. 5 is an enlarged view showing a cleaning frame 124 of FIG. 4. Referring to FIGS. 4 and 5, in the process cartridge B', a waste toner chamber 123 includes a first cleaning frame 124*a* and a second cleaning frame 124*b* on the first cleaning frame 124*a*, and the first cleaning frame 124*a* and second cleaning frame 124*b* are interconnected by a reinforcement member 125 to prevent deformation of the cleaning frame 124. A bent portion 122*a* of a cleaning support member 122 supporting a cleaning blade 121 is bent away from the photosensitive drum 111 towards the cleaning frame 124 (to the left in FIG. 4). In the process cartridge B' having this structure, the overall strength of the cleaning frame 124 is enhanced, and a waste toner space for containing waste toner T is expanded because the reinforcement member 125 is disposed above the bent portion 122*a*. However, in the process cartridge B', the second cleaning frame 124*b* is separately installed on the first cleaning frame 124*a*, and the first cleaning frame 124*a* and the second cleaning frame 124*b* are welded together, then interconnected by the reinforcement member 125. Even though the reinforcement member 125 is disposed above the bent portion 122*a* of the cleaning support member 122, the bent portion 122*a* and the reinforcement member 125 themselves take up some part of the waste toner space.

SUMMARY OF THE INVENTION

According to an aspect of the invention, a process cartridge comprises: a cleaning unit for removing waste toner remaining on a surface of a photosensitive drum; and a cleaning frame for storing the waste toner removed by the cleaning unit, wherein the cleaning unit comprises a bent portion adapted to bend in a direction opposite to the photosensitive drum and be disposed at a site other than that in which the waste toner is accumulated.

According to an aspect of the invention, the cleaning unit comprises a cleaning blade for contacting with the surface of the photosensitive drum to remove the waste toner remaining thereon in response to rotation of the photosensitive drum, and a cleaning support member for supporting the cleaning blade.

According to an aspect of the invention, the bent portion is formed at an upper end of the cleaning support member.

According to an aspect of the invention, the bent portion is disposed above the site in which the waste toner is accumulated.

According to an aspect of the invention, the bent portion is disposed above an upper surface of the cleaning frame, and is bent at an angle of about 90°.

According to an aspect of the invention, the bent portion is formed through molding.

According to an aspect of the invention, the cleaning blade and the cleaning support member is constituted as a single body.

According to an aspect of the invention, the cleaning blade is made of one of urethane, silicone and rubber, and is adapted to have a thickness ranging from 1 to 5 mm.

According to an aspect of the invention, the cleaning blade has a thickness of about 2 mm.

According to an aspect of the invention, the cleaning support member is made of a metallic material.

According to an aspect of the invention, a sealing member is installed between the cleaning unit and cleaning frame.

According to an aspect of the invention, the cleaning frame comprises a first cleaning frame, and a second cleaning frame disposed on the first cleaning frame.

According to an aspect of the invention, an opening is formed in an upper side surface of the cleaning frame, and the bent portion is inserted into the opening.

According to an aspect of the invention, the bent portion is formed at an upper end of the cleaning support member and the bent portion is inserted into the opening of the cleaning frame.

According to an aspect of the invention, the bent portion of the cleaning support member is inserted into the opening so as to protrude out of the opening.

According to an aspect of the invention, the bent portion of the cleaning support member is inserted into the opening so as to hang in the opening.

According to an aspect of the invention, the bent portion is formed at an upper end of the cleaning support member and a protruding portion extending from the bent portion may be inserted into the opening of the cleaning frame.

Additional aspects and/or advantages of the invention will be set forth in part in the description which follows and, in part, will be obvious from the description, or may be learned by practice of the invention.

BRIEF DESCRIPTION OF THE DRAWINGS

The above aspects and/or other features of the present invention will become more apparent by describing in detail exemplary embodiments thereof with reference to the accompanying drawing figures, wherein:

FIGS. 6A and 6C show the process cartridge as a whole and FIG. 6B shows an enlarged portion of the process cartridge;

FIG. 7A shows the process cartridge in a disassembled state and FIG. 7B shows the process cartridge in an assembled state;

FIG. 8A shows the process cartridge in a disassembled state, and FIG. 8B shows the process cartridge in an assembled state.

DETAILED DESCRIPTION OF THE EMBODIMENTS

Figure 1:
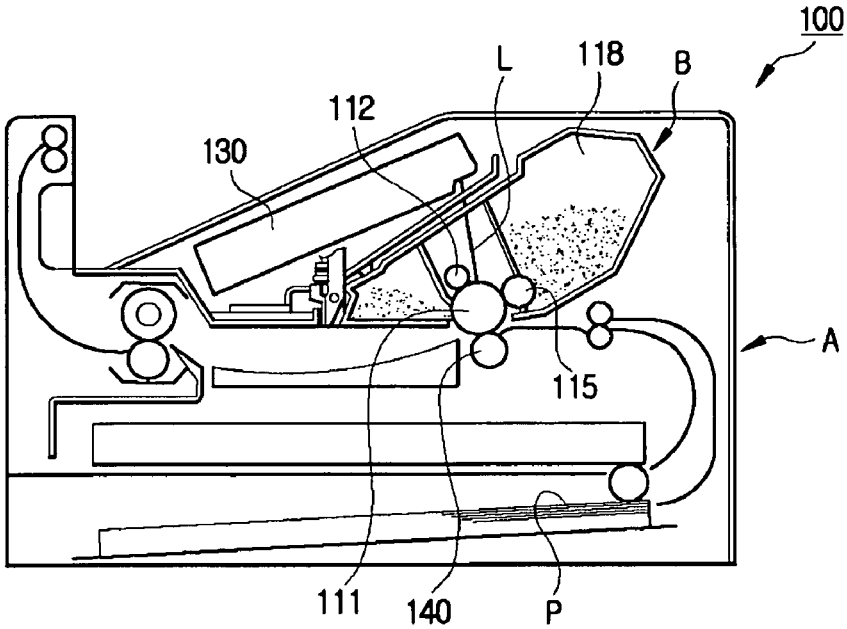
FIG. 1 (PRIOR ART)
FIG. 1 shows the configuration of an electrophotographic image forming apparatus having a conventional process cartridge mounted therein.

Hereinafter, embodiments of the present invention will be described in detail with reference to the accompanying drawing figures. In the following description, like drawing reference numerals are used for the same or similar elements even in different drawings. The matters defined in the description such as a detailed construction and elements are limited to the ones provided to assist in a comprehensive understanding of the invention. Thus, it is apparent that aspects of the present invention can be carried out without those defined matters. Also, well-known functions or constructions are not described in detail since they would obscure the invention in unnecessary detail.

Figure 6A:
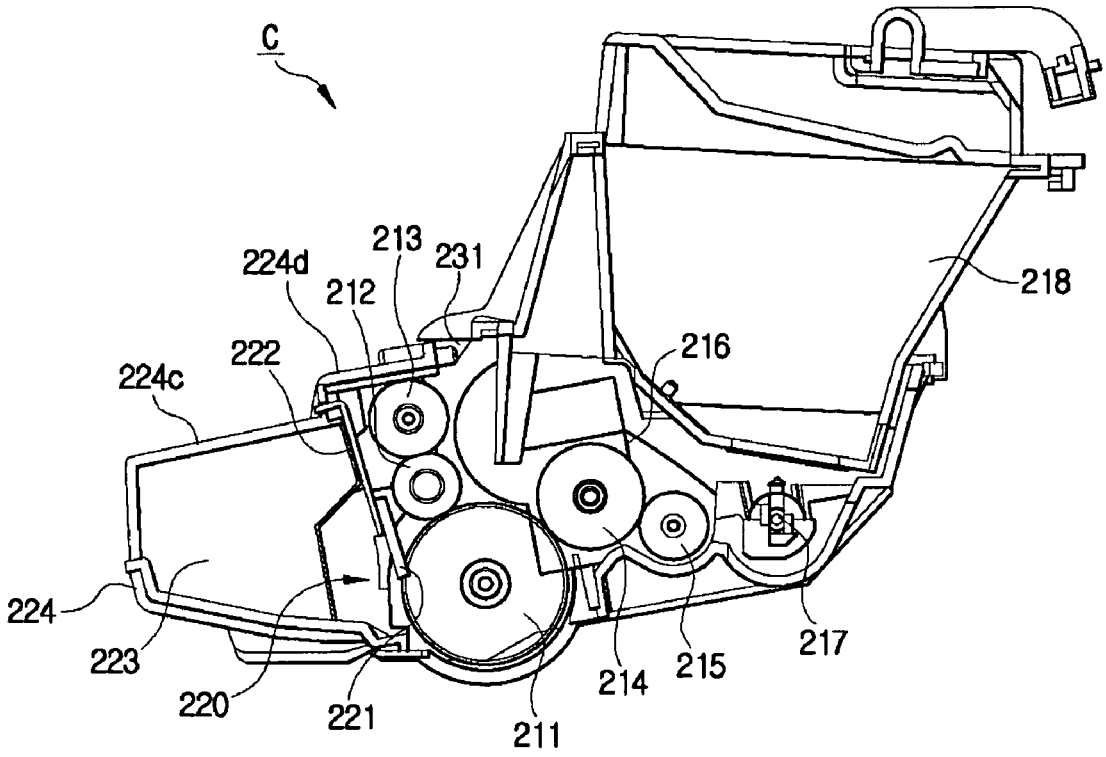
FIGS. 6A through 6C are views showing an internal configuration of a process cartridge according to an embodiment of the present invention where
Figure 6B:
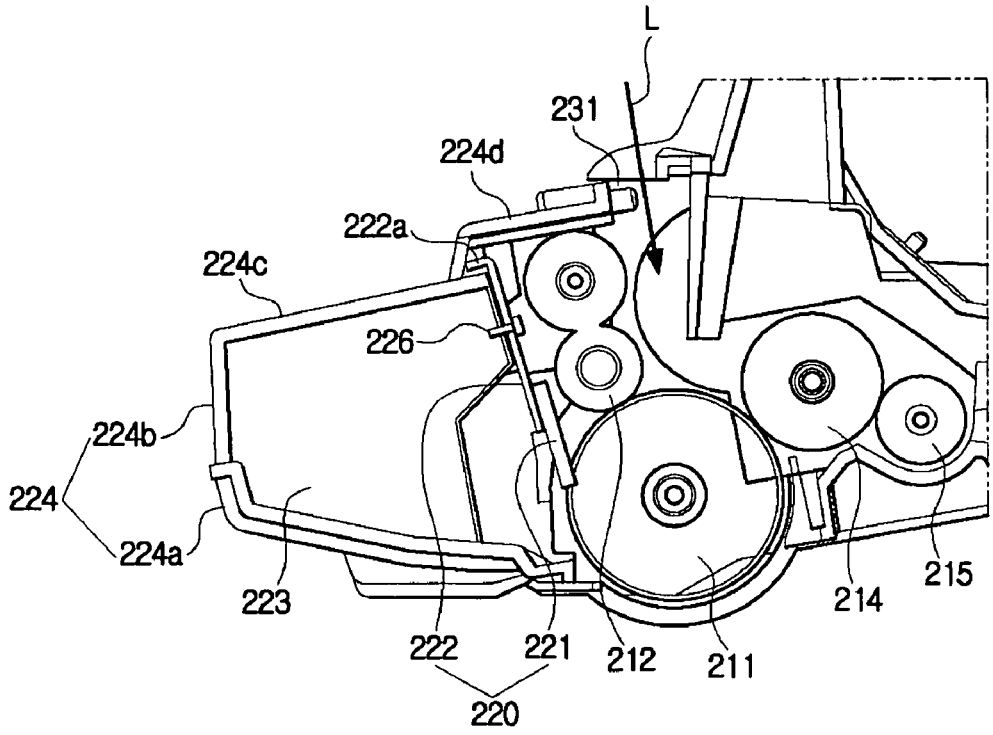
Figure 6C:
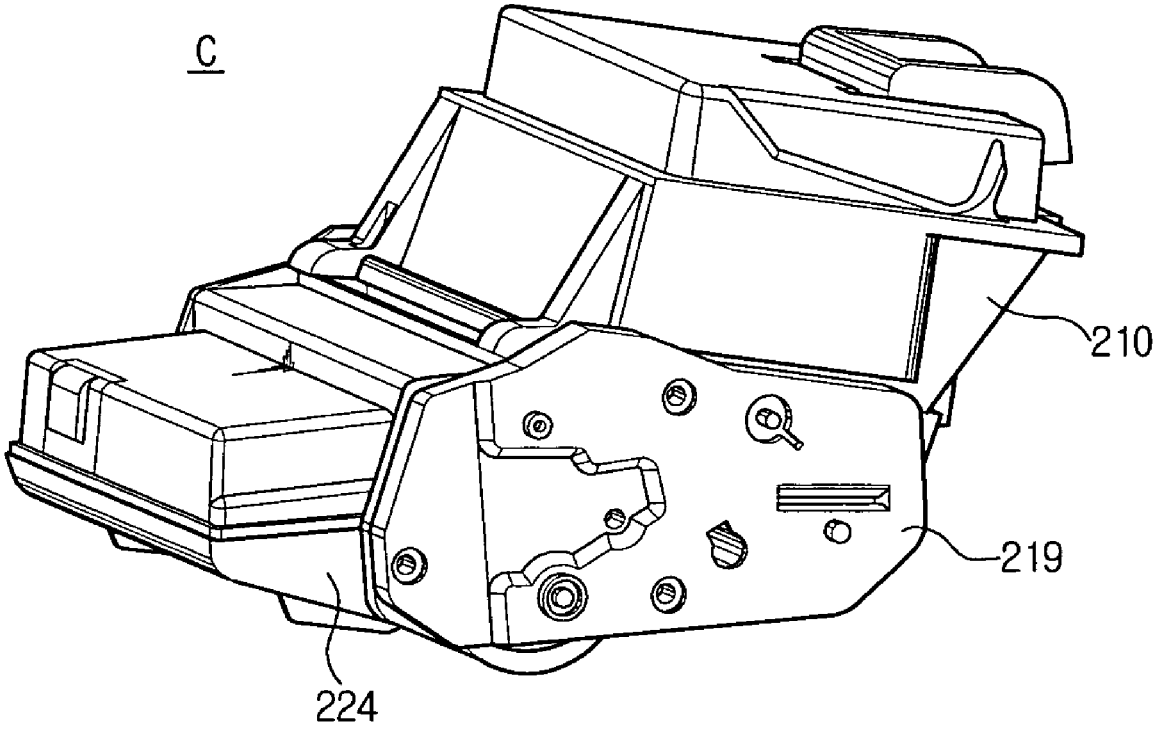

FIGS. 6A and 6B are views showing an internal configuration of a process cartridge C according to an embodiment of the present invention. FIG. 6A shows the process cartridge C as a whole. FIG. 6B shows an enlarged portion of the process cartridge C. FIG. 6C shows a perspective view showing the external appearance of the process cartridge of FIG. 6A. Referring to FIGS. 6A through 6C, the process cartridge C comprises a cartridge frame 210. In the frame 210, a toner chamber 218 is provided at one side of a photosensitive drum 211, and a waste toner chamber 223 provided at the other side of the photosensitive drum 211. Around the toner chamber 218, a developing roller 214, a supplying roller 215, a doctor blade 216, an agitator 217 and the like are installed and supported by a main frame 219. Around the waste toner chamber 223, a charge roller 212, a cleaning unit 220 and the like are installed in sequence and supported by a cleaning frame 224. The process cartridge C has a configuration basically identical to that of the conventional process cartridge B, and a repeated description thereof is thus omitted here except for the differences set forth below.

The process cartridge C is characterized by the structure of the cleaning unit 220 and cleaning frame 224. The cleaning unit 220 is adapted to remove waste toner remaining on the surface of the photosensitive drum 211. The cleaning unit 220 includes a cleaning blade 221, and a cleaning support member 222 for supporting the cleaning blade 221. The cleaning blade 221 is adapted to contact with the surface of the photosensitive drum 211 to remove the waste toner remaining thereon in response to rotation of the photosensitive drum 211. While not required in all aspects of the invention, it is preferable to make the cleaning blade 221 of urethane, silicone or rubber in order to prevent damage to the surface of the photosensitive drum 211 during removal of the waste toner. The cleaning blade 221 may have a thickness of 1 to 5 mm, most preferably, about 2 mm. However, it is understood that the cleaning blade 221 can have other thicknesses and use other materials. Moreover, other materials can be used to prevent damage. Additionally, it is understood that other mechanisms can be used to prevent such surface damage, in which case the usable materials are not limited to those that prevent damage.

The cleaning support member 222 is adapted to support the cleaning blade 221, and further constitutes a side wall or is connected to of the waste toner chamber 223. The cleaning support member 222 is a long member extending in a longitudinal direction of the photosensitive drum 211 (perpendicular to the figure face). Thus, it is necessary to form a bent portion 222*a* at the upper end of the cleaning support member 222 such that the cleaning support member 222 is not be bent or deformed (i.e., the bent portion 222*a* increases a structural rigidity of the support 222).

The bent portion 222*a* may be formed through molding, but can be otherwise formed. In the shown embodiment, it is preferable, but not required, to bend the bent portion 222*a* at an angle of about 90°. However, it is understood that the bend can be at other angles sufficient to impart enough rigidity.

In the shown embodiment, the bent portion 222*a* is formed at a site of the cleaning support member 222 other than a location on which the waste toner is accumulated (i.e., the waste toner chamber 223, and to face away from the photosensitive drum 211. That is, the bent portion 222*a* is bent in a direction opposite to the photosensitive drum 211 and is formed at a site out of the location in which the waste toner is accumulated. It is preferable, but not required, to dispose the bent portion 222*a* above a plane horizontally extended from the upper surface 224*c* of the cleaning frame 224.

According to an aspect of the invention, the cleaning support member 222 and cleaning blade 221 are formed as a single body. However, it is understood that the cleaning support member 222 and cleaning blade 221 may also be adhered to each other by adhesives, or adhered to each other through welding using heat, ultrasonic waves or vibration according to aspects of the invention.

While not required in all aspects of the invention, the cleaning support member 222 is preferably made of a metallic material. The cleaning support member 222 is fixed by fixing members 226 to both side walls 224*h* of the cleaning frame 224 (refer to FIG. 7A).

Figure 7A:
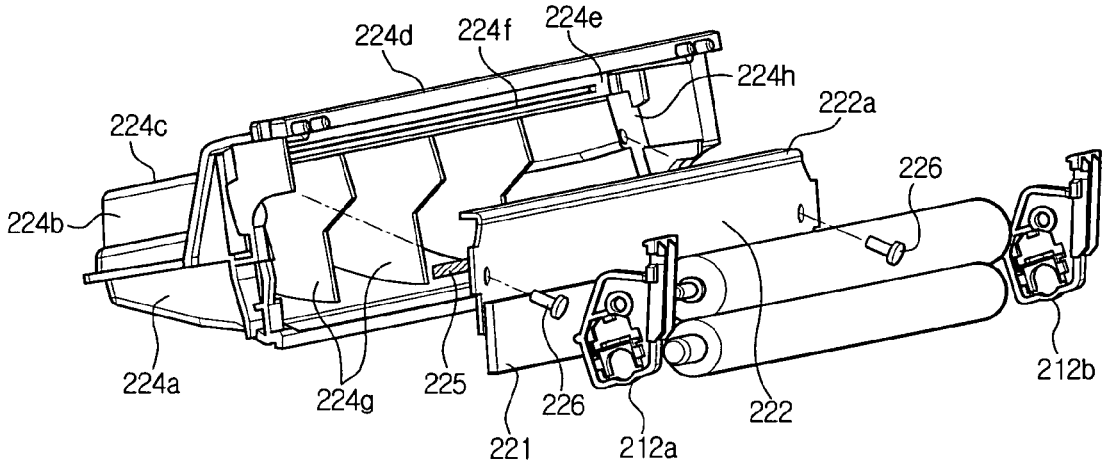
FIGS. 7A and 7B are partial perspective views showing a process cartridge according to an embodiment of the present invention where

According to the aspect of the invention shown in FIG. 7A, a sealing member 225 is installed between the cleaning support member 222 and cleaning frame 224 (refer to FIG. 7A). It is preferable, but not required, to install the sealing member 225 between the inside surface of the bent portion 222*a* and the cleaning frame 224 to prevent leakage of the waste toner. The sealing member 225 may be made of widely used sponge such as polyurethane, silicone, ethylene propylene diene terpolymer (EPDM), chloroprene rubber (CR) and foam, or rubber. The sealing member 225 may also be replaced with an adhesive. If the adhesive is used as a replacement of the sealing member 225, the sealing site need not a space between the cleaning support member 222 and cleaning frame 224. That is, the adhesive is adhered around the outline of a region of the cleaning frame 224 on which the cleaning support member 222 is mounted. As described above, when the bent cleaning unit 220 is fixed to the cleaning frame 224, a plurality of sites of the cleaning unit 220 and cleaning frame 224 are interconnected with fixing members 226 (such as screws) or adhesives between both ends of the cleaning frame 224 or between a lower end and middle part thereof.

Figure 7B:
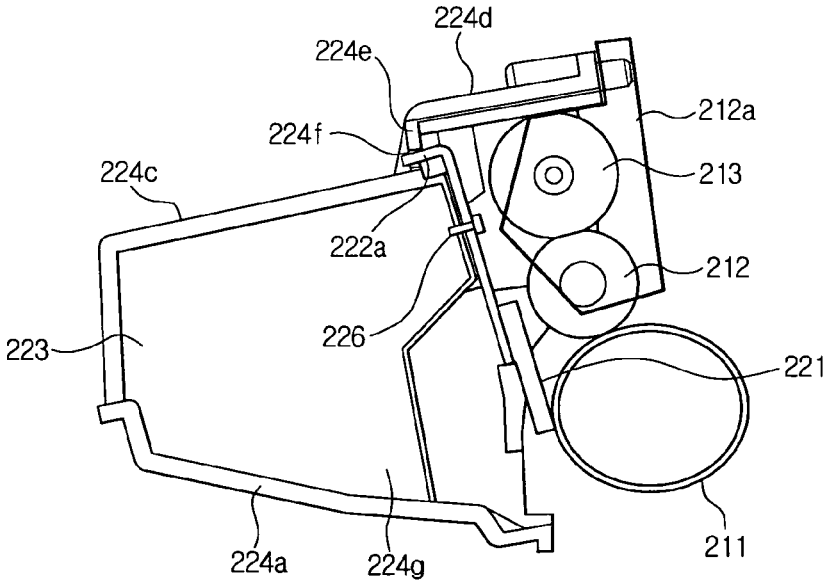

The cleaning frame 224 is adapted to support the cleaning support member 222 and constitutes the waste toner chamber 223 for storing waste toner removed by the cleaning blade 221. The cleaning frame 224 may be configured to include a first cleaning frame 224*a* and a second cleaning frame 224*b* disposed on the first cleaning frame 224*a* as shown in FIGS. 6B and 7B, but can be otherwise constructed in other aspects of the invention or using a single piece so as to define the external surface of the waste toner chamber 226 around which the bent portion 222*a* bends the first cleaning frame 224*a* and the second cleaning frame 224*b* are connected to each other by one of thermal fusing, ultrasonic wave fusing and bonding.

Figure 2:
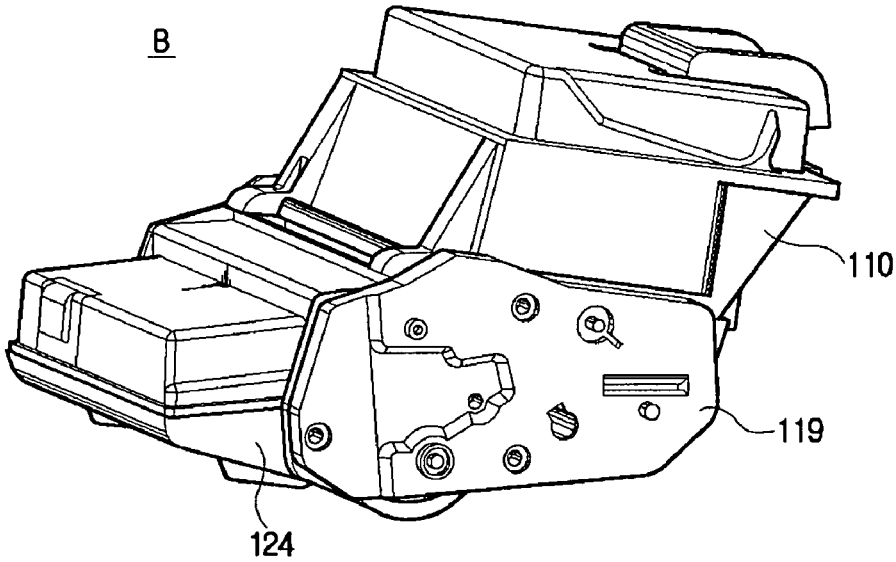
FIG. 2 (PRIOR ART)
FIG. 2 is a perspective view showing the external appearance of the process cartridge of FIG. 1.
Figure 3:
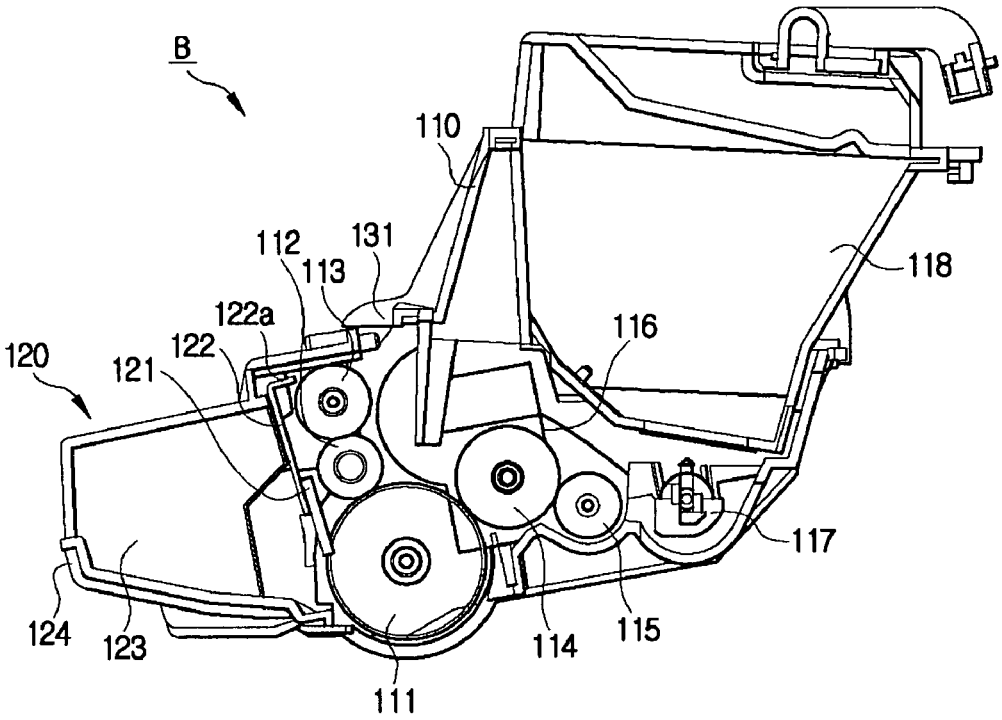
FIG. 3 (PRIOR ART)
FIG. 3 is a sectional view showing the process cartridge of FIG. 2.

In the conventional process cartridge B of FIG. 3, the space taken up by the bent portion 122*a* of the cleaning support member 122 has complicated the problem of space allocation for other components, particularly, the cleaning roller 113, charge roller 112 and beam inlet 131 of the laser scanning unit 130. In the process cartridge C according to the embodiment of the present invention shown in FIGS. 6A and 6B, because the bent portion 222*a* is bent in a direction opposite to the photosensitive drum 211 (i.e., bent towards the cleaning frame 224), the cleaning roller 213 can be shifted further to the left in the figure in comparison with a conventional case shown in FIGS. 2 and 3. Consequently, the space for the incident laser beam L becomes larger, thereby substantially preventing overlap, screening and scattered reflection of the laser beam L due to components in an incident path of the laser beam L. Conventional main frames of the process cartridge B are molded products whose dimensions change particularly depending upon molding conditions or usage conditions. Even in the case of this dimensional change or shrinkage in low temperature environments in particular, the process cartridge C of embodiments of the present invention is adapted to allocate in advance a sufficient space for the incident laser beam, thus preventing interruption of the incident path of the laser beam due to other components.

Figure 4:
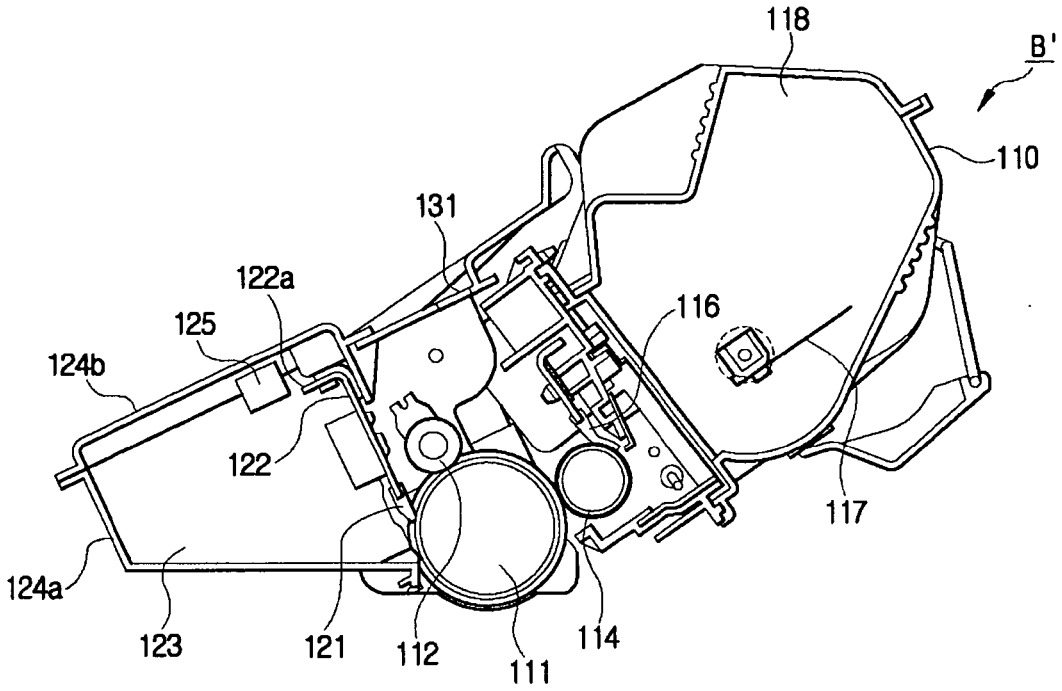
FIG. 4 (PRIOR ART)
FIG. 4 is a sectional view showing another conventional process cartridge.
Figure 5:
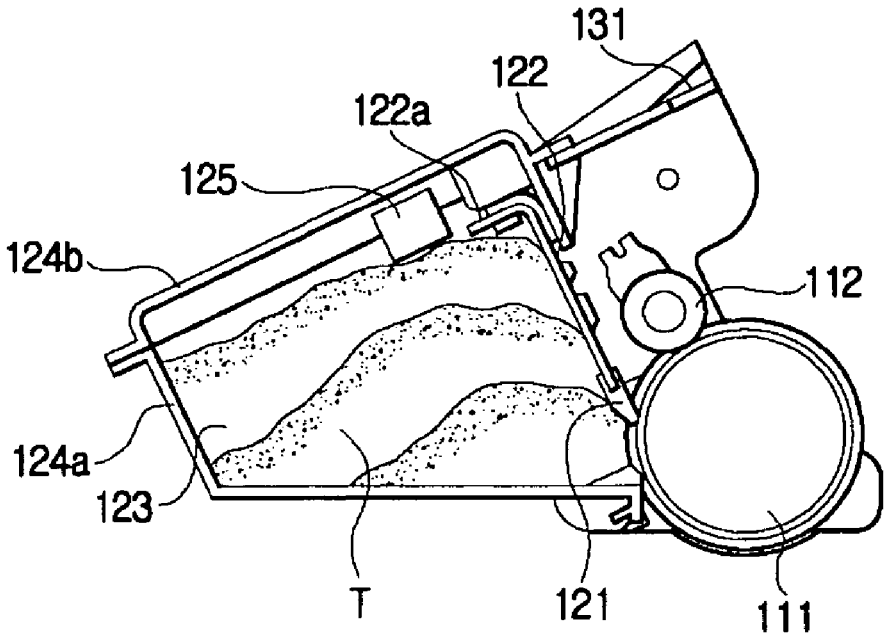
FIG. 5 (PRIOR ART)
FIG. 5 is an enlarged view showing a portion of FIG. 4.

In addition, in the process cartridge C shown in FIGS. 6A and 6B, the bent portion 222*a* of the cleaning support member 222 extends above the waste toner chamber 223. While, in the conventional process cartridge B' shown in FIG. 4 the bent portion 122*a* takes up a portion of the waste toner chamber 123 causing reduction of the capacity thereof, the maximum capacity of the waste toner chamber 223 can be obtained without hindrance of the bent portion 222*a*, as indicated by a dotted line in FIG. 6B, in the process cartridge C of the present embodiment. Although the storable amount of the waste toner may increase with increasing height of the upper surface 224*c* of the waste toner chamber 223, the height thereof is constrained by the height of the image forming apparatus and relations with other components. Accordingly, with the same configuration as that of the conventional case shown in FIGS. 2 through 4, it is possible to efficiently use the limited space of the image forming apparatus by raising the bent portion 222*a* of the cleaning unit 220 up to a height not exceeding the uppermost surface 224*d* of the cleaning frame 224.

While shown in FIGS. 6A and 6B as having the bend defining the bent portion 222*a* being above the waste toner chamber 223, it is understood that the bend can be more gradual and begin below or at the waste toner chamber 223 according to other aspects of the invention so long as the resulting bent portion 222*a* bends towards or around an exterior of the waste toner chamber 223 without interfering with the waste toner chamber 223.

FIGS. 7A and 7B are partial perspective views showing a process cartridge according to an embodiment of the present invention. FIG. 7A shows the process cartridge in a disassembled state, and FIG. 7B shows the process cartridge in an assembled state. Because the process cartridge shown in FIGS. 7A and 7B has a configuration basically identical to that of the embodiment shown in FIGS. 6A and 6B except as outlined below, only the part containing the waste toner chamber 223 is shown in FIGS. 7A and 7B, and a repeated description of the remaining elements is omitted here.

As in the embodiments shown in FIGS. 6A and 6B, the cleaning unit 220 includes the cleaning blade 221 and the cleaning support member 222. The cleaning support member 222 includes the bent portion 222*a*, which is formed at a site other than the location on which the waste toner is accumulated and is adapted to bend in a direction opposite to the photosensitive drum 211. An opening 224*f* is formed in an upper side surface 224*e* of the cleaning frame 224 interconnecting the upper surface 224*c* and uppermost surface 224*d*. The opening 224*f* is formed to extend long in a longitudinal direction of the photosensitive drum. With this opening 224*f*, the bent portion 222*a* of the cleaning support member 222 can be easily assembled to the cleaning frame 224. That is, after the bent portion 222*a* of the cleaning support member 222 is inserted into the opening 224*f* in a partial assembly process, the cleaning support member 222 is assembled through precise alignment to the side walls 224*h* of the cleaning frame 224 using the fixing members 226 or an adhesive. In this case, as shown in FIG. 7B, the bent portion 222*a* of the cleaning support member 222 may project out of the opening 224*f* or hang therein.

As shown in FIG. 7A, a plurality of separating walls 224*g* are installed to reinforce the strength of the cleaning frame 224 and assist orderly accumulation of the waste toner in the waste toner chamber 223. It is preferable to install the sealing member 225 between the cleaning support member 222 and cleaning frame 224. However, it is understood that the walls 224*g* and/or the sealing member 225 need not be used in all aspects of the invention.

For reference, the charge roller 212 and cleaning roller 213 are rotatably installed by roller holders 212*a* and 212*b* placed at opposite sides of the cleaning frame 224.

Figure 8A:
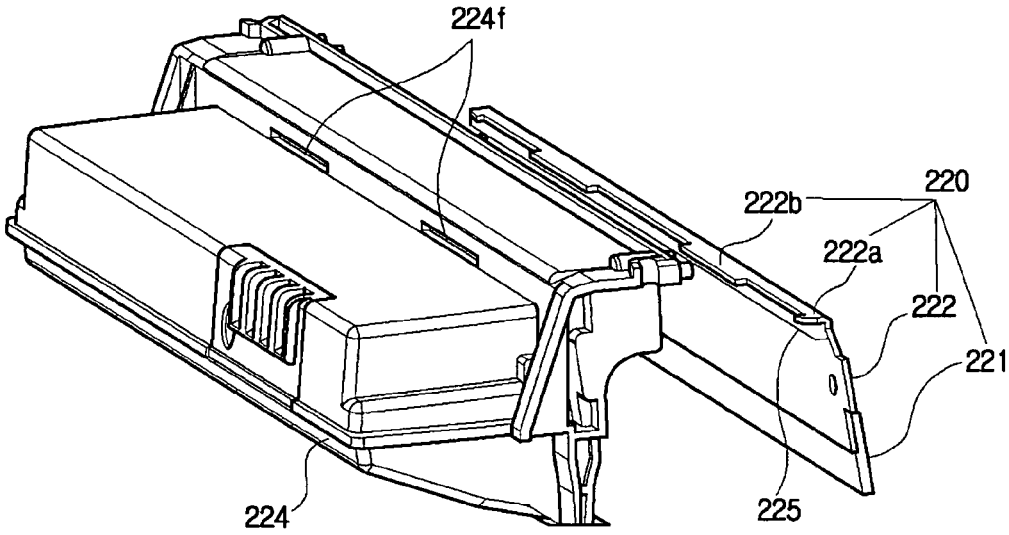
FIGS. 8A and 8B are partial perspective views showing a process cartridge according to an embodiment of the present invention where
Figure 8B:
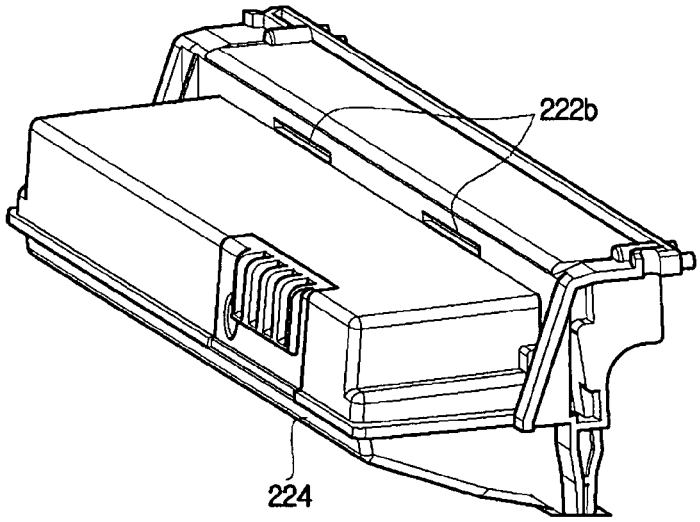

FIGS. 8A and 8B are partial perspective views showing a process cartridge according to an embodiment of the present invention. FIG. 8A shows the process cartridge in a disassembled state, and FIG. 8B shows the process cartridge in an assembled state. Because the process cartridge shown in FIGS. 8A and 8B has a configuration basically identical to that of the embodiment shown in FIGS. 7A and 7B, only the part containing the waste toner chamber 223 is shown in FIGS. 8A and 8B, and a repeated description thereof is omitted here.

As in the embodiment shown in FIGS. 7A and 7B, the cleaning unit 220 includes the cleaning blade 221 and the cleaning support member 222. The cleaning support member 222 includes the bent portion 222*a*, which is formed at a site other than the location on which the waste toner is accumulated and is adapted to bend in a direction opposite to the photosensitive drum 211. The process cartridge of the embodiment shown in FIGS. 8A and 8B is provided with a protruding portion 222*b* extending from the bent portion 222*a*.

In the process cartridge of the embodiment shown in FIGS. 8A and 8B, an opening 224*f* is also formed in the upper side surface 224*e* of the cleaning frame 224 interconnecting the upper surface 224*c* and uppermost surface 224*d*. However, the opening 224*f* is formed piecewise (i.e., as a plurality of smaller openings 224*f*) and is not as long as the opening 224*f* of the embodiment shown in FIGS. 7A and 7B. In the process cartridge of the embodiment shown in FIGS. 7A and 7B, the opening 224*f* is formed to extend long in a longitudinal direction of the cleaning support member 222, and thus both opening-free ends of the cleaning frame 224 may become vulnerable to deformation or warpage. In particular, the roller holders 212*a* and 212*b* are fixed to both ends of the cleaning frame 224. If the ends of the cleaning frame 224 become weak due to the extent of long opening 224*f*, locations of the roller holders 212*a* and 212*b* may be mismatched. Furthermore, when the charge roller 212 rotates while contacting with the photosensitive drum 211, fatigue deformation may develop at the ends of the cleaning frame 224 due to continuous pressure caused by the contact between the charge roller 212 and the photosensitive drum 211, and thus a proper charge nip may be not formed. Accordingly, the process cartridge of the embodiment shown in FIGS. 8A and 8B can remove a weakness due to the long opening 224*f* shown in the embodiment of FIGS. 7A and 7B by using multiple openings 224*f* with elements of the surface 224*e* extending between the openings 224*f*.

In the process cartridge of the embodiment shown in FIGS. 8A and 8B, after the protruding portions 222*b* of the cleaning support member 222 is inserted into the corresponding openings 224*f*, the cleaning support member 222 is firmly assembled to the cleaning frame 224 with fixing members 226 (such as screws) or adhesives.

Figure 9:
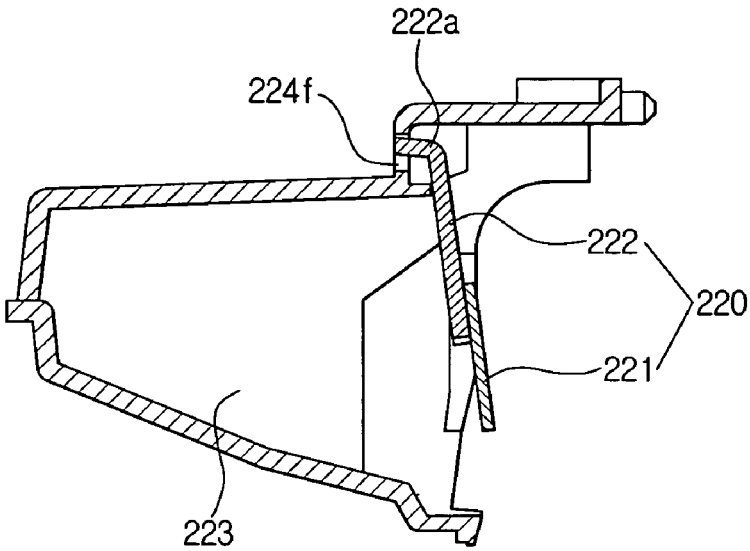
FIGS. 9 to 12 are views showing partial internal configurations of process cartridges according to further embodiments of the present invention.

FIGS. 9 to 12 are views showing various partial configurations of process cartridges according to further embodiments of the present invention. Like the embodiments shown in FIGS. 6A through 7B, the embodiment shown in FIG. 9 has the bent portion 222*a* of the cleaning support member 222 disposed above a waste toner chamber 223 and is inserted into an opening 224*f* of a cleaning frame 224. As shown in FIG. 9, the bent portion 222*a* is adapted to hang and/or be disposed in the opening 224*f* without completely penetrating or extending through the opening 224*f*. As shown, the bent portion 222*a* is at an angle slightly exceeding than the 90°. The process cartridge of FIG. 9 has significant structural advantages over those of the embodiments shown in FIGS. 6A through 7B in terms of sealing or strength of the cleaning frame 224. If a space for installation of such bent portion 222*a* is available, the embodiment of FIG. 9 may be carried out.

Figure 10:
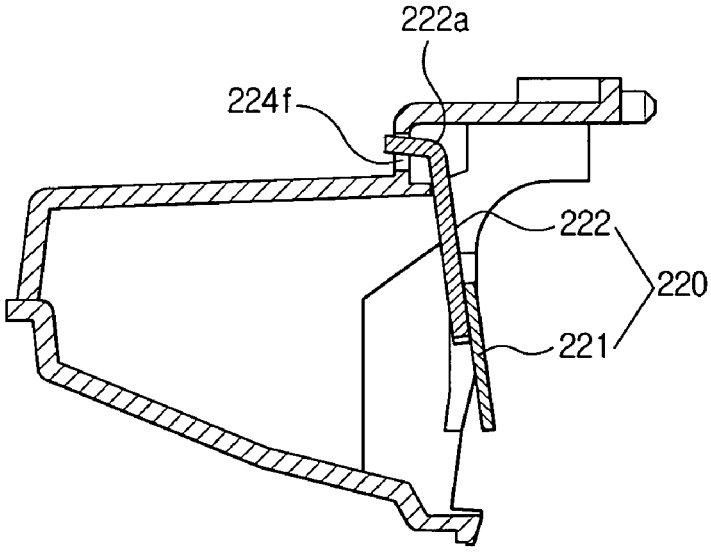

The embodiment of the process cartridge shown in FIG. 10 has the same configuration as that of the embodiment shown in FIGS. 7A and 7B, except that the bent portion 222*a* is formed to have an angle somewhat 90° and passes through the opening 224*f*.

Figure 11:
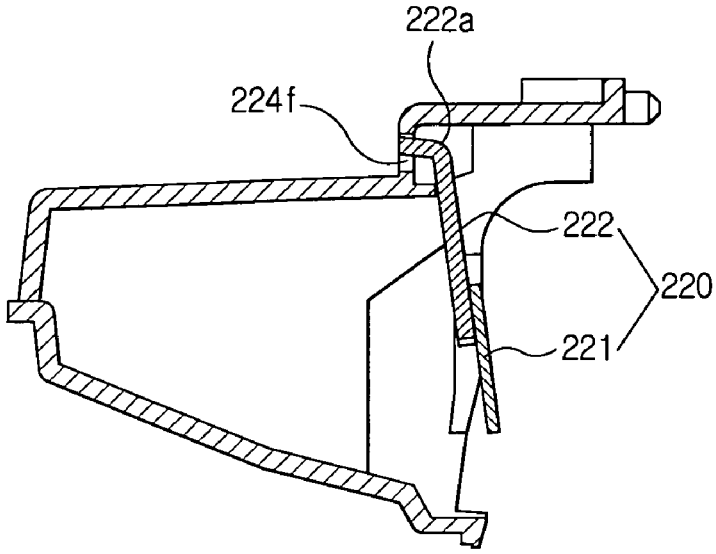

The embodiment of the process cartridge shown in FIG. 11 has the same configuration as the embodiment shown of FIG. 10, except that the bent portion 222*a* is adapted to hang in the openings 224*f* shown in the embodiment in FIG. 8A without completely penetrating the openings 224*f*.

Figure 12:
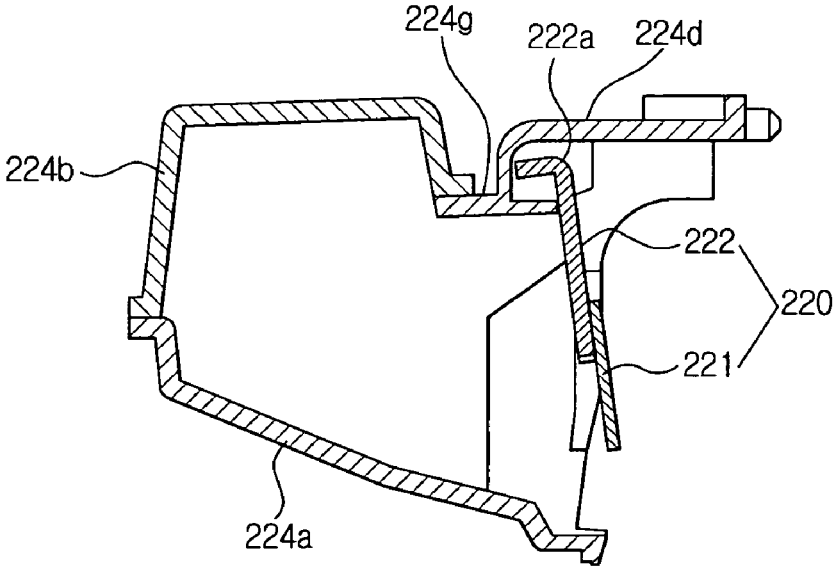

The embodiment of the process cartridge shown in FIG. 12 has the same configuration as that of the embodiment shown in FIGS. 6A and 6B, except that the cleaning frame 224 is configured to include the second cleaning frame 224*b* disposed on the first cleaning frame 224*a*. As compared to FIGS. 6A and 6B in which the second cleaning frame 224*b* extends under the uppermost surface 224*d* of the cleaning frame 224, the second cleaning frame 224*b* rests on an extended portion 224*g* of the uppermost surface 224*d* of the cleaning frame 224.

As described above, a process cartridge having a bent portion of the cleaning unit that is formed to bend towards the waste toner chamber rather than the photosensitive drum and be disposed at a site other than the waste toner chamber conforms to the spirit of the present invention. For example, a new process cartridge according to aspects the present invention may be obtained by combining together the embodiments shown in FIGS. 6A to 12. While various embodiments have been described, an opening-free process cartridge having a bent portion whose configuration is the same as that of the embodiment of FIG. 6A may be the most preferred one if an installation space is available.

As apparent from the above description, aspects of the present invention provides an innovative process cartridge, wherein a sufficient path for an incident laser beam can be obtained and space constraints due to installation of neighboring components such as a charge roller and cleaning roller can be significantly alleviated, permitting a design margin for an image forming apparatus.

In addition to the above structural advantage, quality deterioration in terms of the strength and sealing of a cleaning frame does not occur in the process cartridge. Further, the process cartridge permits a larger capacity of a waste toner chamber, lengthening the service life of the process cartridge.

While the invention has been shown and described with reference to certain embodiments thereof, it will be understood by those skilled in the art that various changes in form and details may be made therein without departing from the spirit and scope of the invention as defined by the appended claims.

What is claimed is:

1. A process cartridge comprising:

a cleaning unit for removing waste toner remaining on a surface of a photosensitive drum, the cleaning unit comprising a first portion which removes the waste toner and a bent portion connected to the first portion;

a cleaning frame having a waste toner chamber for storing the waste toner removed by the cleaning unit, and a charge roller to charge a surface of the photosensitive drum, assembled on the cleaning frame, adjacent to the waste toner chamber, wherein the bent portion bends in a direction away from the photosensitive drum, and extends around an exterior of the waste toner chamber, so as to not be in the waste toner chamber, and wherein the bent portion is disposed above an upper exterior surface of the waste toner chamber.

2. The process cartridge of claim 1, wherein the first portion of the cleaning unit comprises a cleaning blade for contacting with the surface of the photosensitive drum to remove the waste toner remaining thereon in response to a rotation of the photosensitive drum, and a cleaning support member extends towards the bent portion for supporting the cleaning blade.

3. The process cartridge of claim 2, wherein the bent portion is formed at an upper end of the cleaning support member.

4. The process cartridge of claim 1, wherein the bent portion is disposed above an upper surface of the cleaning frame.

5. The process cartridge of claim 3, wherein the bent portion is formed through molding.

6. The process cartridge of claim 3, wherein the bent portion is bent at an angle of about 90°.

7. The process cartridge of claim 2, wherein the cleaning blade and the cleaning support member are constituted as a single body.

8. The process cartridge of claim 2, wherein the cleaning blade is made of one of urethane, silicone and rubber.

9. The process cartridge of claim 2, wherein the cleaning blade has a thickness ranging from 1 to 5 mm.

10. The process cartridge of claim 9, wherein the cleaning blade has a thickness of about 2 mm.

11. The process cartridge of claim 2, wherein the cleaning support member is made of a metallic material.

12. The process cartridge of claim 1, further comprising a sealing member between the cleaning unit and cleaning frame.

13. The process cartridge of claim 1, wherein the cleaning frame comprises a first cleaning frame, and a second cleaning frame disposed on the first cleaning frame.

14. The process cartridge of claim 13, wherein the first cleaning frame and the second cleaning frame are connected to each other by one of thermal fusing, ultrasonic wave fusing and bonding.

15. A process cartridge comprising:

a cleaning unit having a first portion for removing waste toner remaining on a surface of a photosensitive drum and a bent portion;

a cleaning frame having an upper side surface with an opening formed into which the bent portion is inserted, and a waste toner chamber for storing the waste toner removed by the cleaning unit; and a charge roller to charge a surface of the photosensitive drum, assembled on the cleaning frame, adjacent to the waste toner chamber, wherein the bent portion bends in away from the photosensitive drum, and around an exterior surface of the waste toner chamber, so as to be disposed at a site other than that in which the waste toner is accumulated, and wherein the bent portion is disposed above an upper exterior surface of the waste toner chamber.

16. The process cartridge of claim 15, wherein the first portion of the cleaning unit comprises a cleaning blade for contacting with the surface of the photosensitive drum to remove the waste toner remaining thereon in response to a rotation of the photosensitive drum, and a cleaning support member extending towards the bent portion for supporting the cleaning blade.

17. The process cartridge of claim 16, wherein the bent portion is formed at an upper end of the cleaning support member.

18. A process cartridge comprising:

a cleaning unit having a first portion for removing waste toner remaining on a surface of a photosensitive drum and a bent portion; and a cleaning frame having an upper side surface with an opening formed into which the bent portion is inserted, and a waste toner chamber for storing the waste toner removed by the cleaning unit, wherein:

the first portion of the cleaning unit comprises a cleaning support member extending towards the bent portion for supporting the cleaning blade, and the bent portion bends in away from the photosensitive drum and around an exterior surface of the waste toner chamber, to be disposed at a site other than that in which the waste toner is accumulated, is formed at an upper end of the cleaning support member, extends through the opening, so as to protrude out of the opening, and is disposed above an upper exterior surface of the waste toner chamber.

19. The process cartridge of claim 18, wherein the bent portion is inserted into the opening so as to hang in the opening.

20. The process cartridge of claim 15, wherein the cleaning frame comprises a first cleaning frame, and a second cleaning frame disposed on the first cleaning frame.

21. The process cartridge of claim 20, wherein the first cleaning frame and the second cleaning frame are connected to each other by one of thermal fusing, ultrasonic wave fusing and bonding.

22. The process cartridge of claim 15, wherein the bent portion is disposed above an upper surface of the cleaning frame, the upper side surface being above the upper surface.

23. The process cartridge of claim 15, further comprising a sealing member is installed between the cleaning unit and cleaning frame.

24. The process cartridge of claim 16, wherein the bent portion is at an upper end of the cleaning support member and includes a protruding portion extending from the bent portion into the opening of the cleaning frame.

25. A process cartridge comprising:

a photosensitive drum on which a latent image is developed into a desired visible image with toner;

a cleaning frame having a waste toner chamber for storing waste toner removed from the photosensitive drum;

a cleaning unit having a first portion for removing the waste toner from the photosensitive drum, and a curved portion to support the first portion, and which curves around an exterior surface of the waste tone chamber, so as to be disposed above an upper exterior surface of the waste toner chamber; and a charge roller to charge a surface of the photosensitive drum, assembled on the cleaning frame, adjacent to the waste toner chamber.

26. The process cartridge of claim 25, wherein the cleaning frame comprises a first cleaning frame and a second cleaning frame disposed on the first cleaning frame.

27. The process cartridge of claim 26, wherein the first cleaning frame and the second cleaning frame are connected to each other by one of thermal fusing, ultrasonic wave fusing and bonding.

28. The process cartridge of claim 25, wherein the cleaning unit includes a connecting portion extending from the curved portion to the first portion and which is attached to a first wall of the waste toner chamber.

29. The process cartridge of claim 28, wherein:

the waste toner chamber comprises a second wall connected to the first wall, and the curved portion includes an extended portion extending around but not through the first and second walls such that the second wall is between the waste toner chamber and the extended portion and the first wall is between the waste toner chamber and the connecting portion.

30. A process cartridge comprising:

a photosensitive drum on which a latent image is developed into a desired visible image with toner;

a cleaning frame having a waste toner chamber for storing waste toner removed from the photosensitive drum;

a cleaning unit having a first portion for removing the waste toner from the photosensitive drum, a curved portion to support the first portion, which curves around an exterior surface of the waste tone chamber, and a connecting portion extending from the curved portion to the first portion and which is attached to a first wall of the waste toner chamber; and a housing frame defining an interior including the photosensitive drum and the cleaning unit, wherein:

the waste toner chamber comprises a second wall connected to the first wall, the curved portion of the cleaning unit includes an extended portion extending around but not through the first and second walls, such that the second wall is between the waste toner chamber and the extended portion and the first wall is between the waste toner chamber and the connecting portion, the housing frame has an opening, and the extended portion extends into the opening, so as to be disposed above an upper exterior surface of the waste toner chamber.

31. The process cartridge of claim 30, wherein the extended portion extends through the opening.

32. A process cartridge comprising:

a photosensitive drum on which a latent image is developed into a desired visible image with toner;

a cleaning frame having a waste toner chamber for storing waste toner removed from the photosensitive drum;

a cleaning unit having a first portion for removing the waste toner from the photosensitive drum, a curved portion to support the first portion, which curves around an exterior surface of the waste tone chamber, and a connecting portion extending from the curved portion to the first portion and which is attached to a first wall of the waste toner chamber, wherein:

the waste toner chamber comprises a second wall connected to the first wall, the curved portion of the cleaning unit includes an extended portion extending around but not through the first and second walls, such that the second wall is between the waste toner chamber and the extended portion, and the first wall is between the waste toner chamber and the connecting portion, and the cleaning frame has a third wall extending from the second wall of the waste toner chamber, which includes an opening, and the extended portion extends into the opening, so as to be disposed above an upper exterior surface of the waste toner chamber.

33. The process cartridge of claim 32, wherein the extended portion extends through the opening.

34. The process cartridge of claim 25, wherein:

the cleaning unit includes a connecting portion extending from the first portion to the curved portion in a first direction away from the photosensitive drum, and the curved portion includes an extended portion extending in a second direction other than the first direction.

35. A process cartridge comprising:

a photosensitive drum on which a latent image is developed into a desired visible image with toner;

a cleaning frame having a waste toner chamber for storing waste toner removed from the photosensitive drum;

a cleaning unit having a first portion for removing the waste toner from the photosensitive drum, a curved portion to support the first portion, which curves around an exterior surface of the waste tone chamber, and a connecting portion extending from the first portion to the curved portion in a first direction away from the photosensitive drum; and a housing frame defining an interior including the photosensitive drum and the cleaning unit, wherein:

the curved portion includes an extended portion extending in a second direction other than the first direction, the housing frame has an opening, and the extended portion extends into the opening in the housing frame, so as to be disposed above an upper exterior surface of the waste toner chamber.

36. The process cartridge of claim 35, wherein:

the opening comprises a plurality of openings in the housing frame, and the extended portion comprises a plurality of extended portions which extend into the corresponding openings.

37. The process cartridge of claim 34, wherein the first direction is substantially perpendicular to the second direction.

38. A process cartridge comprising:

a photosensitive drum on which a latent image is developed into a desired visible image with toner;

a cleaning frame having a waste toner chamber for storing waste toner removed from the photosensitive drum;

a cleaning unit having a first portion for removing the waste toner from the photosensitive drum, a curved portion to support the first portion, which curves around an exterior surface of the waste tone chamber, and a connecting portion extending from the first portion to the curved portion in a first direction away from the photosensitive drum; and a housing frame other than the cleaning frame and defining an interior including the photosensitive drum and the cleaning unit, wherein:

the curved portion of the cleaning unit includes an extended portion extending in a second direction other than the first direction, the cleaning frame includes an opening, and the extended portion extends into the opening, so as to be disposed above an upper exterior surface of the waste toner chamber.

39. The process cartridge of claim 38, wherein:

the opening comprises a plurality of openings in the cleaning frame, and the extended portion comprises a plurality of extended portions which extend into the corresponding openings.

40. An image forming apparatus which forms an image on a medium using toner supplied by the process cartridge of claim 25.

* * * * *